US010280597B2

(12) United States Patent
Izumikawa

(10) Patent No.: US 10,280,597 B2
(45) Date of Patent: May 7, 2019

(54) SHOVEL

(71) Applicant: SUMITOMO(S.H.I.) CONSTRUCTION MACHINERY CO., LTD., Tokyo (JP)

(72) Inventor: Takeya Izumikawa, Chiba (JP)

(73) Assignee: SUMITOMO(S.H.I)CONSTRUCTION MACHINERY CO., LTD., Tokyo (JP)

( * ) Notice: Subject to any disclaimer, the term of this patent is extended or adjusted under 35 U.S.C. 154(b) by 0 days.

(21) Appl. No.: 15/715,648

(22) Filed: Sep. 26, 2017

(65) Prior Publication Data

US 2018/0016771 A1 Jan. 18, 2018

Related U.S. Application Data

(63) Continuation of application No. PCT/JP2016/058872, filed on Mar. 18, 2016.

(30) Foreign Application Priority Data

Mar. 27, 2015 (JP) ..... 2015-067683

(51) Int. Cl.
*E02F 9/26* (2006.01)
*E02F 9/20* (2006.01)

(52) U.S. Cl.
CPC ..... *E02F 9/264* (2013.01); *E02F 9/20* (2013.01); *E02F 9/26* (2013.01)

(58) Field of Classification Search
CPC ... E02F 3/32; E02F 3/435; E02F 9/261; E02F 9/26; E02F 9/264; E02F 9/265; E02F 9/20; G01S 19/14; G01S 19/53; G01S 19/54
USPC ..... 37/347, 348; 172/2–11; 701/50, 469
See application file for complete search history.

(56) References Cited

U.S. PATENT DOCUMENTS

| | | | | |
|---|---|---|---|---|
| 8,942,895 | B2 * | 1/2015 | Nomura | E02F 9/26 701/469 |
| 2005/0027420 | A1 * | 2/2005 | Fujishima | E02F 9/2045 701/50 |
| 2013/0066527 | A1 | 3/2013 | Mizuochi et al. | |
| 2014/0058635 | A1 | 2/2014 | Furukawa et al. | |
| 2014/0100712 | A1 | 4/2014 | Nomura et al. | |
| 2015/0004572 | A1 * | 1/2015 | Bomer | G09B 9/042 434/219 |

(Continued)

FOREIGN PATENT DOCUMENTS

| | | |
|---|---|---|
| EP | 1342853 | 9/2003 |
| JP | H09-028106 | 2/1997 |

(Continued)

OTHER PUBLICATIONS

International Search Report for PCT/JP2016/058872 dated May 31, 2016.

*Primary Examiner* — Robert E Pezzuto
(74) *Attorney, Agent, or Firm* — IPUSA, PLLC

(57) ABSTRACT

A shovel includes an attachment configured to execute work; a guidance unit configured to guide an operation of the attachment; and a display unit configured to display information related to the work by the attachment. The guidance unit changes color of a partial area or an entire area of a display screen of the display unit, depending on a distance between a position of the attachment while the work is being performed and a target surface as a reference of the work.

10 Claims, 9 Drawing Sheets

(56) References Cited

U.S. PATENT DOCUMENTS

| | | | | |
|---|---|---|---|---|
| 2015/0029017 | A1* | 1/2015 | Thoreson | B60K 35/00 340/461 |
| 2015/0345114 | A1 | 12/2015 | Nomura et al. | |
| 2016/0010312 | A1 | 1/2016 | Kurihara et al. | |
| 2016/0193920 | A1 | 7/2016 | Tsubone et al. | |
| 2017/0175362 | A1* | 6/2017 | Iwanaga | E02F 3/435 |
| 2018/0094408 | A1* | 4/2018 | Shintani | E02F 9/26 |

FOREIGN PATENT DOCUMENTS

| | | |
|---|---|---|
| JP | 2001-123476 | 5/2001 |
| JP | 2001-136180 | 5/2001 |
| JP | 2003-049446 | 2/2003 |
| JP | 2004-197398 | 7/2004 |
| JP | 2007-009432 | 1/2007 |
| JP | 2008-000131 | 1/2008 |
| JP | 2014-074315 | 4/2014 |
| JP | 2014-101664 | 6/2014 |
| JP | 2014-129676 | 7/2014 |
| JP | 2014-148893 | 8/2014 |
| WO | 2011/148946 | 12/2011 |
| WO | 2014/054327 | 4/2014 |
| WO | 2014/132903 | 9/2014 |

* cited by examiner

SHOVEL

CROSS-REFERENCE TO RELATED APPLICATIONS

This application is a continuation application of International Application PCT/JP2016/058872 filed on Mar. 18, 2016, and designated the U.S., which claims priority based on Japanese Patent Application No. 2015-067683 filed on Mar. 27, 2015. The entire contents of each of the foregoing applications are incorporated herein by reference.

BACKGROUND

Technical Field

The present disclosure relates to a shovel having a machine guidance function.

Description of Related Art

In order to efficiently and precisely perform excavation work or the like by using an attachment of a construction machine such as a shovel, skilled operation techniques are required of an operator. Thereupon, there have been shovels that are equipped with functions to guide operations of the shovels (referred to as "machine guidance") so that an operator less experienced with shovel operations can perform work efficiently and precisely.

It is often the case that such a shovel having a machine guidance function has a display unit installed diagonally in front of the driver's seat, to display information including working states on the screen of the display unit. The operator of the shovel can confirm the work states by the shovel by visually recognizing the information displayed on the display unit.

The size of the display unit is limited so as not to obstruct the field of view ahead of the operator. Therefore, an image displayed on the display unit is also small, and the operator may need to carefully watch the screen of the display unit, otherwise, cannot obtain information that he/she wants.

On the other hand, the operator of the shovel performs the work while looking at the teeth end of the bucket and an excavation spot that are positioned ahead of the driver's seat, and hence, cannot see the display unit for a long time during the work. For example, even if the operator of the shovel can take a look at the display unit during the work, the time during which he looks at the display unit is extremely short; therefore, it is often difficult to recognize desired information in an image displayed on the display unit within such a short period of time.

SUMMARY

According to an embodiment, a shovel includes an attachment configured to execute work; a guidance unit configured to guide an operation of the attachment; and a display unit configured to display information related to the work by the attachment. The guidance unit changes color of a partial area or an entire area of a display screen of the display unit, depending on a distance between a position of the attachment while the work is being performed and a target surface as a reference of the work.

DETAILED DESCRIPTION

In the following, embodiments of the present invention will be described with reference to the drawings.

According to an embodiment, it is possible to provide a shovel having a display unit that is capable of informing an operator about information related to working states, by just looking at an image displayed on the display unit for a short time or without focusing his/her attention on the displayed screen.

Figure 1:
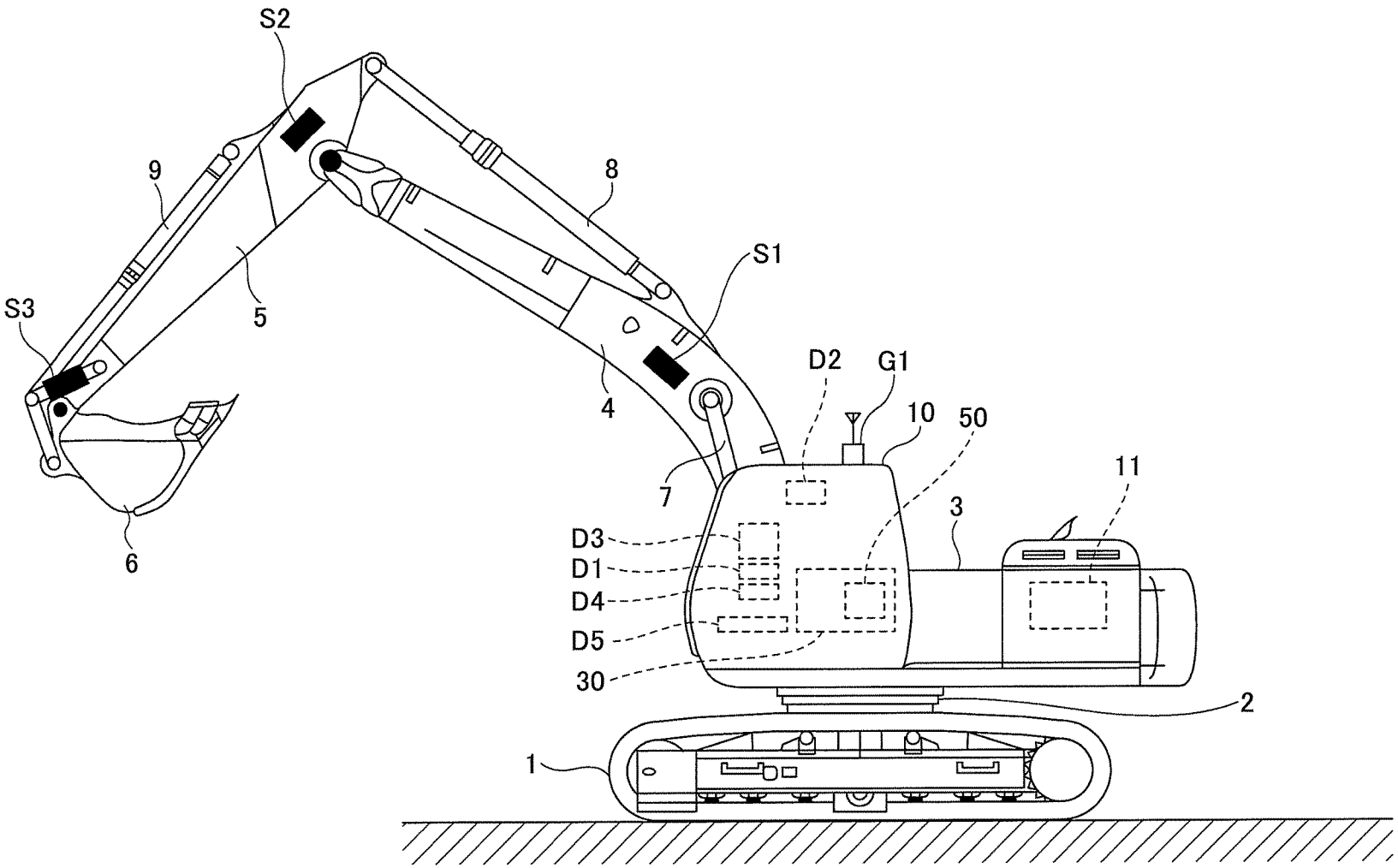
FIG. 1 is a side view of a shovel according to an embodiment of the present invention.

FIG. 1 is a side view of a shovel according to an embodiment. A revolving upper body 3 is mounted on a traveling lower body 1 of the shovel via a revolution mechanism 2. A boom 4 is attached to the revolving upper body 3. An arm 5 is attached at the tip of the boom 4, and a bucket 6 as an end attachment is attached at the tip of the arm 5. As the end attachment, a bucket for slope surface, a bucket for dredging, or the like may be used.

As an example of an attachment, the boom 4, the arm 5, and the bucket 6 constitute an excavation attachment, which are oil-pressure driven by a boom cylinder 7, an arm cylinder 8, and a bucket cylinder 9, respectively. A boom angle sensor S1 is attached to the boom 4, an arm angle sensor S2 is attached to the arm 5, and a bucket angle sensor S3 is attached to the bucket 6. The excavation attachment may have a bucket tilt mechanism provided. The boom angle sensor S1, the arm angle sensor S2, and the bucket angle sensor S3 may be referred to as "orientation sensors".

The boom angle sensor S1 detects a rotation angle of the boom 4. In the embodiment, the boom angle sensor S1 is an acceleration sensor that detects inclination to the level surface, and detects a rotation angle of the boom 4 with respect to the revolving upper body 3. The arm angle sensor S2 detects a rotation angle of the arm 5. In the embodiment, the arm angle sensor S2 is an acceleration sensor that detects inclination to the level surface, and detects a rotation angle of the arm 5 with respect to the boom 4. The bucket angle sensor S3 detects a rotation angle of the bucket 6. In the embodiment, the bucket angle sensor S3 is an acceleration sensor that detects inclination to the level surface, and detects a rotation angle of the bucket 6 with respect to the arm 5. If the excavation attachment has a bucket tilt mechanism provided, the bucket angle sensor S3 additionally detects a rotation angle of the bucket 6 around the tilt axis. The boom angle sensor S1, the arm angle sensor S2, and the bucket angle sensor S3 may be a potentiometer using a variable resistor, a stroke sensor that detects the amount of strokes of the corresponding oil pressure cylinder, a rotary encoder that detects the rotation angle around a linking pin, or the like.

The revolving upper body 3 has a cabin 10, and has a power source such as an engine 11 installed. A GPS unit (a GNSS receiver) G1 is provided on a top part of the cabin 10. The GPS unit G1 detects the position of the shovel by a GPS function, and supplies the positional data to the machine guidance unit 50 in a controller 30. Besides, in the cabin 10, an input unit D1, a sound output unit D2, a display unit D3, a memory unit D4, and the controller 30 are installed.

The controller 30 functions as a main controller that executes drive control of the shovel. In the embodiment, the controller 30 is constituted with an arithmetic processing unit including a CPU and an internal memory. Various functions of the controller 30 are implemented by the CPU that runs a program stored in the internal memory.

The controller 30 also functions as the machine guidance unit 50 that guides operations of the shovel. In the embodiment, the machine guidance unit 50 visually and auditorily informs the operator, for example, about a distance in the perpendicular direction between the surface of a target geographical feature set by the operator and a working part of an attachment. The working part of the attachment includes the tip (teeth end) of the bucket 6 as an end attachment, the back surface of the bucket 6, the tip of the breaker as an end attachment, and the like. As such, the machine guidance unit 50 guides operations of the shovel performed by the operator. Note that the machine guidance unit 50 may only visually inform the operator, or may only auditorily inform the operator, about the distance.

Although the machine guidance unit 50 is built in the controller 30 according to the embodiment, the machine guidance unit 50 may be provided as a unit separate from the controller 30. In this case, similar to the controller 30, the machine guidance unit 50 is constituted with an arithmetic processing unit including a CPU and an internal memory. Various functions of the machine guidance unit 50 are implemented by the CPU that runs a program stored in the internal memory.

The input unit D1 is a device for an operator of the shovel to input various information items into the controller 30 including the machine guidance unit 50. In the embodiment, the input unit D1 is a membrane switch attached to the surface of the display unit D3. A touch panel or the like may be used as the input unit D1.

The sound output unit D2 outputs various audio information items in response to a sound output command from the machine guidance unit 50 included in the controller 30. In the embodiment, an in-vehicle speaker directly connected to the machine guidance unit 50 is used as the sound output unit D2. Note that an alarm such as a buzzer may be used as the sound output unit D2.

The display D3 displays various image information items in response to a command from the machine guidance unit 50 included in the controller 30. In the embodiment, an in-vehicle liquid crystal display connected to the machine guidance unit 50 is used as the display unit D3.

The memory unit D4 is a device for storing various information items. In the embodiment, a non-volatile storage medium, such as a semiconductor memory, is used as the memory unit D4. The memory unit D4 stores various information items output by the controller 30 including the machine guidance device 500, or the like.

The gate lock lever D5 is a mechanism to prevent the shovel from being operated erroneously. In the embodiment, the gate lock lever D5 is placed between the door of the cabin 10 and the driver's seat. If the gate lock lever D5 is pulled up so that the operator cannot leave the cabin 10, various operation units become operational. On the other hand, if the gate lock lever D5 is pressed down so that the operator can leave the cabin 10, various operation units become not operational.

Figure 2:
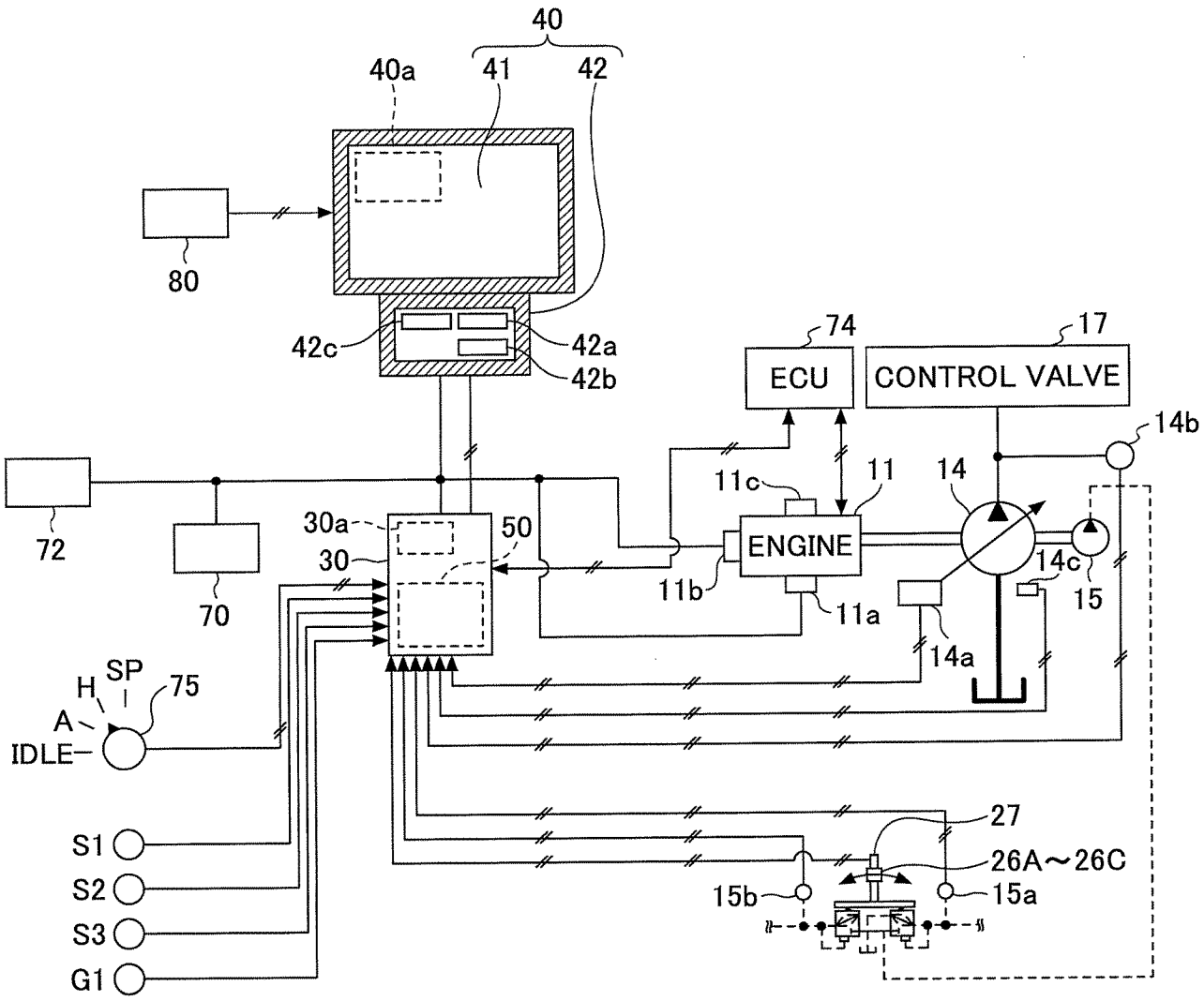
FIG. 2 is a block diagram illustrating connection between a controller of a shovel and an image display unit.

FIG. 2 is a block diagram illustrating connection between the controller 30 and the image display unit 40 of the shovel. The image display unit 40 corresponds to the display unit D3 described above, to display information supplied from the machine guidance unit 50 on a display screen. In the embodiment, the image display unit 40 is connected to the controller 30 including the machine guidance unit 50 via a communication network such as a Controller Area Network (CAN) and a Local Interconnect Network (LIN). Note that the image display unit 40 may be connected to the controller 30 via a dedicated line.

The image display unit 40 includes a conversion processor 40*a* that generates an image to be displayed on the image display part 41. In the embodiment, the conversion processor 40*a* generates a camera image to be displayed on the image display part 41, based on output of the imaging unit 80. Therefore, the imaging unit 80 is connected to the image display unit 40, for example, via a dedicated line.

The conversion processor 40*a* converts data of an information item to be display on the image display part 41 among data items input into the image display unit 40, into an image signal. The data input into the image display unit 40 includes image data from the imaging unit 80. The imaging unit 80 may include, for example, a left-side monitoring camera, a back monitoring camera, and a right-side monitoring camera. In this case, image data output from each of the left-side monitoring camera, the back monitoring camera, and the right-side monitoring camera is input into the image display unit 40.

The conversion processor 40*a* generates an image to be displayed on the image display part 41, based on output of the controller 30. In the embodiment, the conversion processor 40*a* converts data of an information item to be display on the image display part 41 among data items input into the controller 30, into an image signal. The data input into the controller 30 includes, for example, data representing the temperature of engine cooling water, data representing the temperature of hydraulic operating fluid, data representing the residual quantity of urea water, data representing the residual quantity of fuel. The conversion processor 40*a* outputs the converted image signal to the image display part 41, to display the corresponding image on the image display part 41.

Note that the conversion processor 40*a* may be implemented as a function included in the controller 30, rather than a function included in the image display unit 40. In this case, the imaging unit 80 is connected to the controller 30 instead of the image display unit 40.

The image display unit 40 includes a switch panel 42 as an input unit 42. The switch panel 42 is a panel including various hardware switches. In the embodiment, the switch panel 42 includes a light switch 42*a*, a wiper switch 42*b*, and a window washer switch 42*c* as hardware buttons. The light switch 42*a* is a switch for switching between turning on and off of lights attached to the outside of the cabin 10. The wiper switch 42*b* is a switch for switching between activation and stoppage of the wiper. Also, the window washer switch 42*c* is a switch for spraying window washer liquid.

The image display unit 40 operates on power supplied from a storage battery 70. Note that the storage battery 70 is charged by power generated by an alternator 11*a* (dynamo) of the engine 11. The power of the storage battery 70 is also supplied to electric parts 72 and the like of the shovel, other than the controller 30 and the image display unit 40. A starter 11*b* of the engine 11 is also driven by the power from the storage battery 70, to start the engine 11.

The engine 11 is controlled by an engine control unit (ECU) 74. The ECU 74 constantly transmits various data items representing states of the engine 11 (for example, data representing cooling water temperature (a physical quantity) detected by a water temperature sensor 11*c*), to the controller 30. Therefore, the controller 30 may store such data in an internal temporary storage unit (a memory) 30*a*, to transmit the data to the image display unit 40 when necessary.

Various items of data are supplied to the controller 30 as follows, and they are stored in the temporary storage unit 30*a* of the controller 30.

First, data representing a swash plate angle is supplied to the controller 30 from a regulator 14*a* of a main pump 14, which is a variable displacement hydraulic pump. Also, data representing discharge pressure of the main pump 14 is sent to the controller 30 from a discharge pressure sensor 14*b*. These data items (data items representing physical quantities) are stored in the temporary storage unit 30*a*. Besides, an oil temperature sensor 14*c* is provided on a conduit between the main pump 14 and a tank in which hydraulic operating fluid that flows into the main pump 14 is stored, and data representing the temperature of the hydraulic operating fluid that flows through the conduit is supplied to the controller 30 from the oil temperature sensor 14*c*.

Pilot pressure sent to a control valve 17 when control levers 26A-26C are operated is detected by oil pressure sensors 15*a* and 15*b*, and data representing the detected pilot pressure is supplied to the controller 30. A switch button 27 is provided on each of the control levers 26A-26C. The operator can send a command signal to the controller 30 by operating the switch button 27, while operating each of the control levers 26A-26C. The controller 30 controls the machine guidance function and other functions of the shovel, based on a command signal supplied by an operation on the switch button 27.

Figure 5:
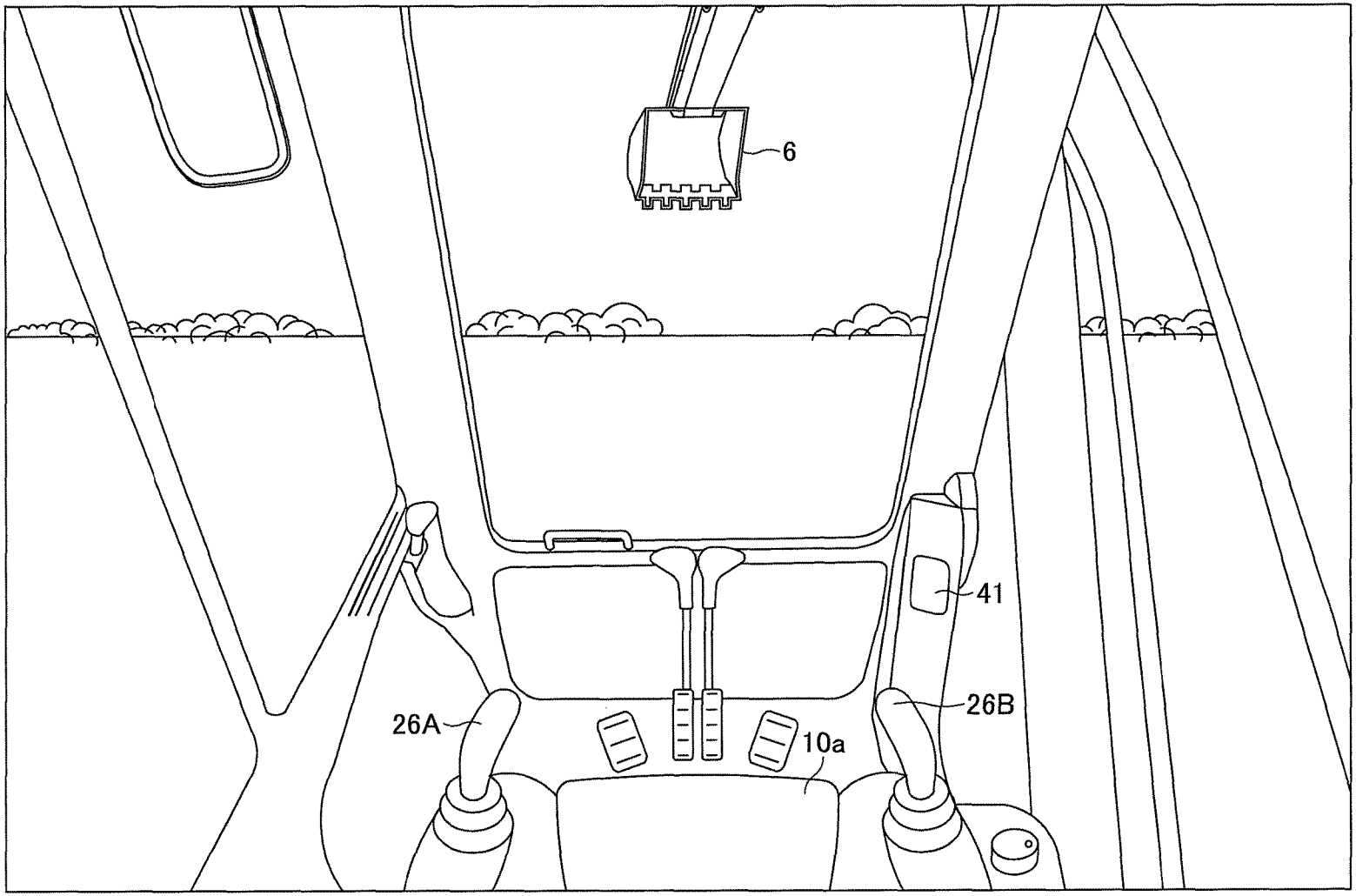
FIG. 5 is a view in front of a shovel when viewing from the driver's seat in the cabin.

Furthermore, in the embodiment, the shovel is provided with an engine revolution adjustment dial 75 in the cabin 10. The engine revolution adjustment dial 75 is a dial for adjusting the number of revolutions of the engine, with which the number of revolutions of the engine can be switched by four steps in the embodiment. Also, from the engine revolution adjustment dial 75, data representing the setting state of the number of revolutions of the engine is constantly transmitted to the controller 30. Also, the engine revolution adjustment dial 75 enables to switch the number of revolutions of the engine in four steps, which are SP mode, H mode, A mode, and idling mode. Note that FIG. 5 illustrates a state in which the H mode is selected by the engine revolution adjustment dial 75.

The SP mode is a revolution mode selected when it is desirable to prioritize the workload, which uses the highest number of revolutions of the engine. The H mode is a revolution mode selected when it is desirable to prioritize both the workload and the fuel consumption, which uses the second highest number of revolutions of the engine. The A mode is a revolution mode selected when it is desirable to operate the shovel with low noise while prioritizing the fuel consumption, which uses the third highest number of revolutions of the engine. The idling mode is a revolution mode selected when it is desirable to put the engine into an idling state, which uses the lowest number of revolutions of the engine. Once one of the revolution modes has been set by the engine revolution adjustment dial 75, the engine 11 is controlled to operate by the number of revolutions of the mode.

Figure 3:
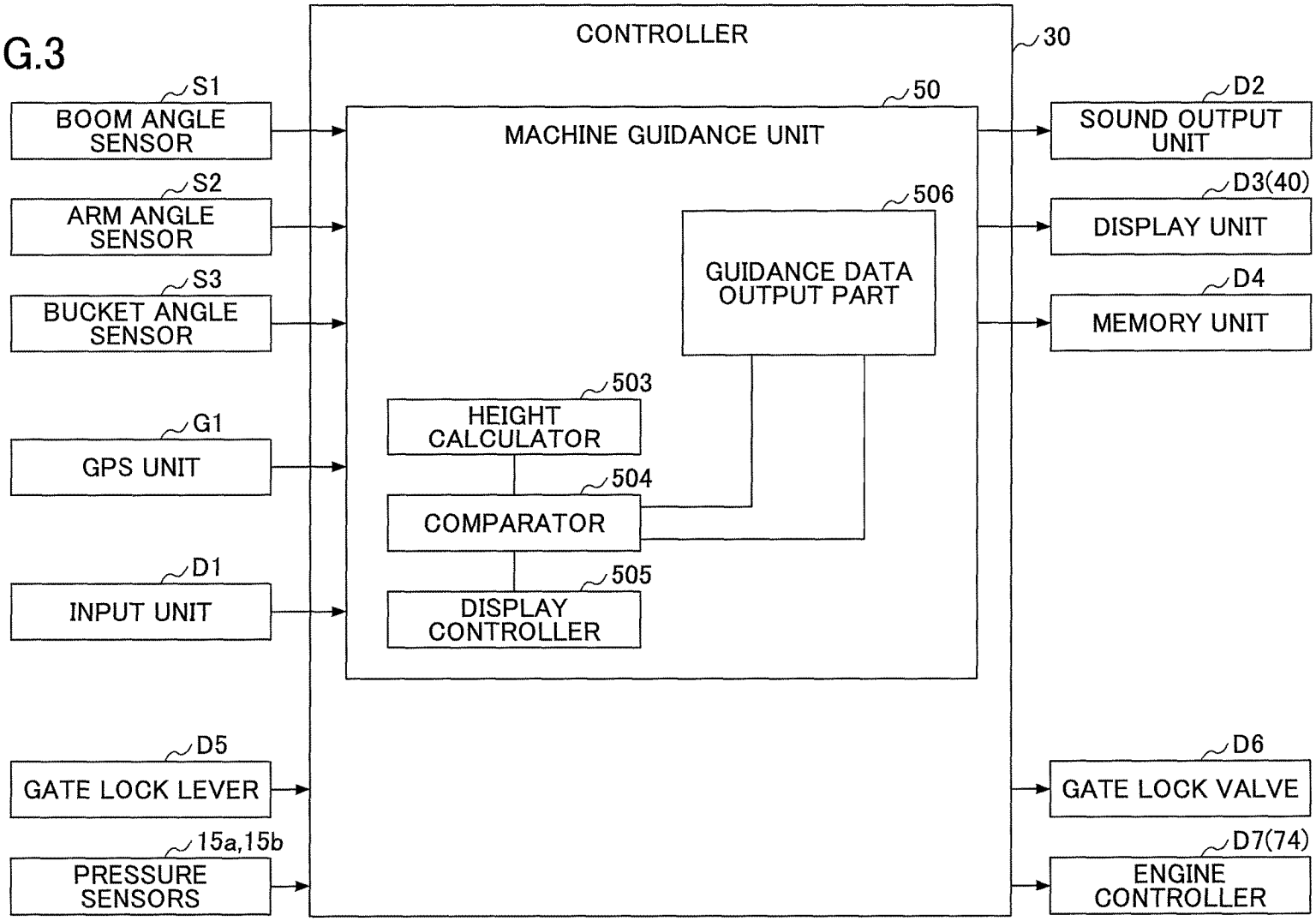
FIG. 3 is a block diagram illustrating a functional configuration of a controller and a machine guidance device.

Next, referring to FIG. 3, various functional elements provided in the controller 30 and the machine guidance unit 50 will be described. FIG. 3 is a functional block diagram illustrating a configuration of the controller 30 and the machine guidance unit 50.

In the embodiment, in addition to controlling operations of the entire shovel, the controller 30 controls whether to execute guidance by the machine guidance unit 50. Specifically, the controller 30 determines whether the shovel is inactive based on the state of the gate lock lever D5, detection signals from oil-hydraulic pressure sensors 15*a*-15*b*, and the like. Then, if having determined that the shovel is inactive, the controller 30 sends a guidance stop command to the machine guidance unit 50 so that guidance by the machine guidance unit 50 is to be stopped.

Also, when outputting an automatic idling stop command to an engine controller D7, the controller 30 may output a guidance stop command to the machine guidance unit 50. Note that the engine controller D7 corresponds to the ECU 74 in FIG. 2. Alternatively, if having determined that the gate lock lever D5 is in a pressed-down state, the controller 30 may output a guidance stop command to the machine guidance unit 50.

Next, the machine guidance unit 50 will be described. In the embodiment, the machine guidance unit 50 receives various signals and data output from the boom angle sensor S1, the arm angle sensor S2, the bucket angle sensor S3, the GPS unit G1, the input unit D1, and the controller 30. The machine guidance unit 50 calculates an actual working position of an attachment (for example, the bucket 6), based on a received signal and data. Then, if the actual working position of the attachment is different from a target working position, the machine guidance unit 50 transmits a notification command to the sound output unit D2 and the display unit D3, to issue a notification about the difference to the operator. If the machine guidance unit 50 is provided as a unit separate from the controller 30, the machine guidance unit 50 and the controller 30 are connected to a CAN (Controller Area Network) so as to be capable of communicating with each other.

The machine guidance unit 50 includes functional units that execute various functions. In the embodiment, the machine guidance unit 50 includes a height calculator 503, a comparator 504, a display controller 505, and a guidance data output unit 506, as functional units for guiding operations of the attachment.

The height calculator 503 calculates a height at the tip (teeth end) of the bucket 6 from angles of the boom 4, the arm 5, and the bucket 6 calculated from detection signals of the sensors S1-S3.

The comparator 504 compares the height at a tip (teeth end) of the bucket 6 calculated by the height calculator 503, with the target height of the tip (teeth end) of the bucket 6 represented by the guidance data output from the guidance data output unit 506.

Based on a comparison result obtained by the comparator 504, if having determined that displaying is required, the display controller 505 transmits a display control command to the display unit D3. In response to receiving the display control command, the display unit D3 displays a predetermined display (an image illustrating positions of the target line and the bucket, or the like) on the screen of the display unit, to notify the comparison result to the operator of the shovel.

As described above, from the guidance data stored in advance in the memory unit of the machine guidance unit 50, the guidance data output unit 506 extracts data corresponding to the target height of the bucket 6, and outputs the data to the comparator 504.

Next, display control executed by the display controller 505 of the machine guidance unit 50 will be described according to the embodiment.

Figure 4:
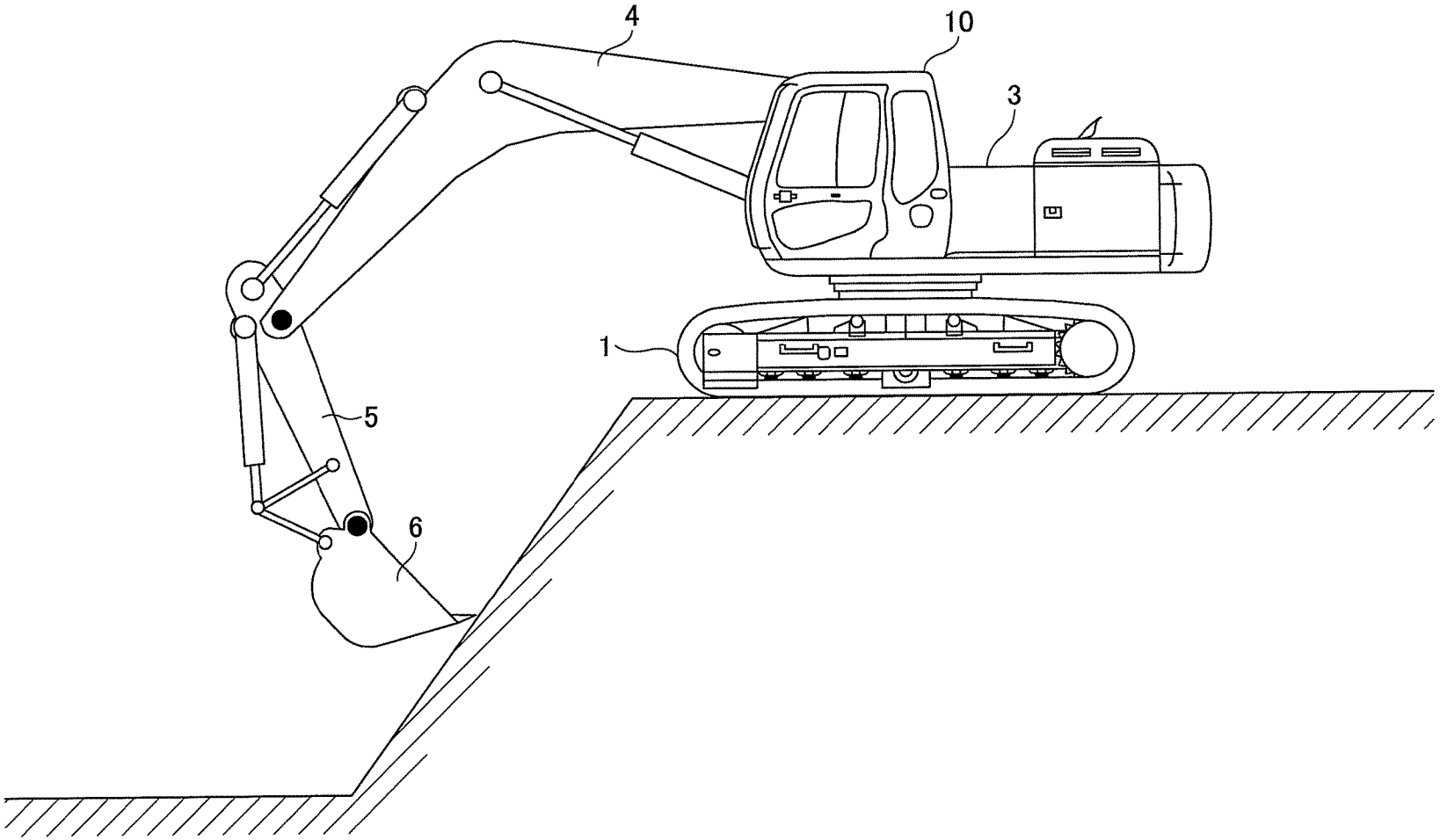
FIG. 4 is a diagram illustrating excavation work on a slope surface, using a shovel.

The display control to be described in the following is display control executed by the image display unit 40 showing a guidance display while the bucket 6 of the shovel is being operated to perform excavation work on a slope surface (slope) as illustrated in FIG. 4. The display control according to the embodiment is not limited to excavation work on a slope surface, and may be applicable to horizontal excavation work and other work.

FIG. 5 is a diagram illustrating a frontal view seen from the inside of the cabin 10 of the shovel. Through the window on the front side of the cabin 10, the bucket 6 can be seen. The bearing surface of the driver's seat 10*a* is illustrated in a lower center part in FIG. 5, and the control levers 26A and 26B are illustrated on both sides of the seat. The driver having seated on the driver's seat grasps the control lever 26A by the left hand and grasps the control lever 26B by the right hand, and moves the bucket 6 to a desired position, to perform the excavation work.

The image display part (display screen) 41 of the image display unit 40 is placed at a lower right part of the front window frame. In a state where the operator of the shovel is looking at the work with the bucket 6 outside of the window, the image display part 41 is in a corner of the operator's field of view. However, since the image display part 41 is a comparatively small area within the range of the operator's field of view, in order to confirm the information displayed on the image display part, the operator needs to turn his eyes on the display part for carefully looking at the image display part.

Thereupon, in the embodiment, the display color of a partial or entire area of the image display part 41 is changed so that information is notified to the operator not only by the image but also by changing the color. Such display control will be described in the following.

Figure 6:
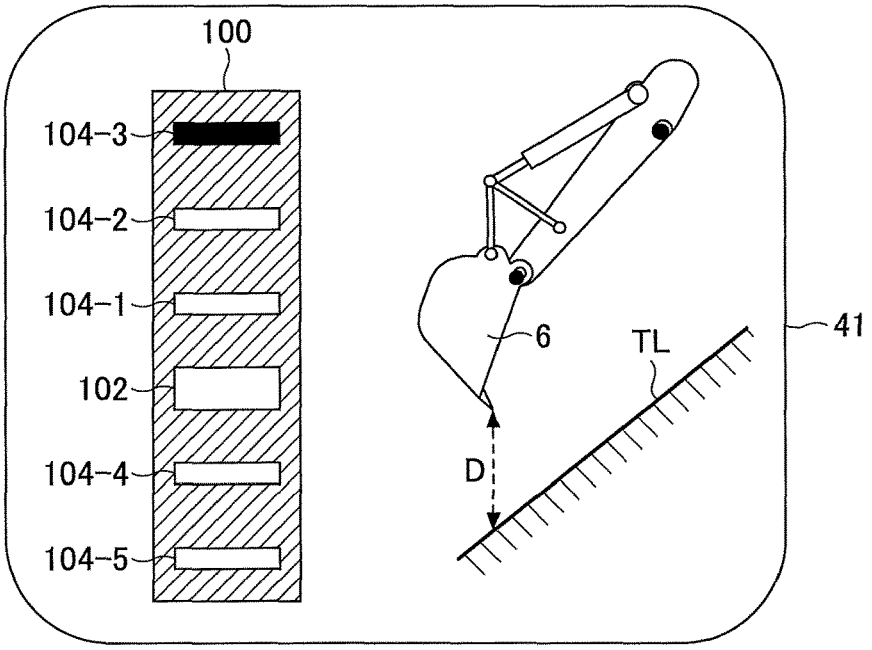
FIG. 6 is a diagram illustrating a display on an image display part when performing excavation work on a slope surface as illustrated in FIG. 5.

FIG. 6 is a diagram illustrating an example of an image displayed on the image display part (display screen) 41 when performing excavation work on a slope surface as illustrated in FIG. 5. In the following, the image display part 41 may be also referred to as "the display screen 41".

In the display screen 41 illustrated in FIG. 6, on the right-hand side of the screen, a target surface is designated by a target line TL (a slant line), down to which the excavation is to be done, and the current position of the bucket 6 with respect to the target line is designated by the outer frame shape of the bucket. On the display screen 41, the distance in the vertical direction between the teeth end of the bucket 6 and the target line TL changes depending on an actual distance in the vertical direction between the teeth end of the bucket 6 and the target surface. As information that the worker wants to know from this display, information about how much the tip (teeth end) of the bucket 6 has approached the target line TL (in practice, the target surface), may be considered. In order to obtain such information, the operator needs to compare the image of the bucket with the target line TL on the small display screen, so as to confirm the distance between them, for determining the actual distance. In other words, the operator who is performing the work with the bucket 6 sometimes needs to keep an eye on the display screen 41, to confirm the position of the tip of the bucket 6 with respect to the target line TL on the display screen 41.

Thereupon, the display control according to the embodiment provides, as illustrated in FIG. 6, a display area 100 for displaying the bucket position is on the left-side area of the display screen 41, so that the distance between the teeth end of the bucket 6 and the target surface can be simply and visually confirmed. On the display area 100, a bar (target surface display bar) 102 representing the target surface (target line) is displayed, and above and below the bar 102, bars (bucket position display bars) 104-1 to 104-5 are displayed at predetermined intervals to indicate the position of the bucket. These bars are displayed to indicate the following information items, respectively.

The target surface display bar 102 indicates that the position of the teeth end of the bucket 6 does not exceed a range with respect to the target surface, for example, ±5 cm.

Among the three bars above the target surface display bar 102, the bucket position display bar 104-3 positioned uppermost indicates that the vertical distance from the teeth end of the bucket 6 to the target surface is, for example, 50 cm or longer and 100 cm or shorter. Also, among the three bars above the target surface display bar 102, the bucket position display bar 104-2 positioned at the center indicates that the vertical distance from the teeth end of the bucket 6 to the target surface is, for example, 20 cm or longer and 50 cm or shorter. Furthermore, among the three bars above the target surface display bar 102, the bucket position display bar 104-1 positioned lowermost and closest to the target surface display bar 102, indicates that the vertical distance from the teeth end of the bucket 6 to the target surface is, for example, 5 cm or longer and 20 cm or shorter.

Also, among the two bars below the target surface display bar 102, the bucket position display bar 104-4 closer to the target surface display bar 102 indicates that the vertical distance from the teeth end of the bucket 6 to the target surface is, for example, −5 cm or longer and −10 cm or shorter. In other words, the bucket position display bar 104-4 indicates that too much excavation work has been done beyond the target surface by the depth from 5 cm to 20 cm. Furthermore, among the two bars below the target surface display bar 102, the bucket position display bar 104-5 away from the target surface display bar 102 indicates that the vertical distance from the teeth end of the bucket 6 to the target surface is, for example, −10 cm or longer and −30 cm or shorter. In other words, the bucket position display bar 104-4 indicates that too much excavation work has been done beyond the target surface by the depth from 10 cm to 30 cm.

According to the display control in the embodiment, in the display area 100, the frame showing the external shape of the target surface display bar 102 is displayed larger than the frame showing the external shape of the target surface display bars 104-1 to 104-5. Accordingly, it is possible to distinguish the target surface display bar 102 from the bucket position display bars 104-1 to 104-5. For example, by designating with dashed lines the frames showing the external shapes of the target surface display bars 104-1 to 104-5, it is possible to more clearly distinguish the target surface display bar 102 from the bucket position display bars 104-1 to 104-5.

The target surface display bar 102 and the bucket position display bars 104-1 to 104-5 are displayed, for example, with black frames, and one of the bucket position display bars corresponding to the current position of the teeth end of the bucket 6 is painted in black within the frame. In FIG. 6, since the bucket position display bar corresponding to the current position of the teeth end of the bucket 6 is the bucket position display bar 104-3, only the bucket position display bar 104-3 is painted in black within the frame. On the other hand, the other bucket position display bars are painted in white within the frames. Accordingly, it is possible to easily and visually recognize how much distance the position of the teeth end of the bucket 6 has from the target surface. Note that if the teeth end of the bucket 6 is positioned close to the target surface, the bucket position display bar 104-2 is painted in black within the frame, and the other bucket position display bars 104-1 to 104-5 are painted in white within the frames. Alternatively, only the frame of the target surface display bar 102 may be displayed by solid lines, and the frames of the bucket position display bars 104-1 to 104-5 may be displayed by another type of lines, such as dashed lines. Furthermore, the colors used within the frames of the target surface display bar 102 and the bucket position display bars 104-1 to 104-5 are not limited to black and white. Also, instead of painting in white, only the frame may be displayed.

In addition, in the example of the display illustrated in FIG. 6, depending on the distance D between the teeth end of the bucket 6 and the target surface, the color of the entire display area 100 is changed. If the distance between the teeth end of the bucket 6 and the target surfaces is a distance D illustrated in FIG. 6, only the bucket position display bar 104-3 is painted in black, and the entire display area 100 is displayed in red.

Figure 7:
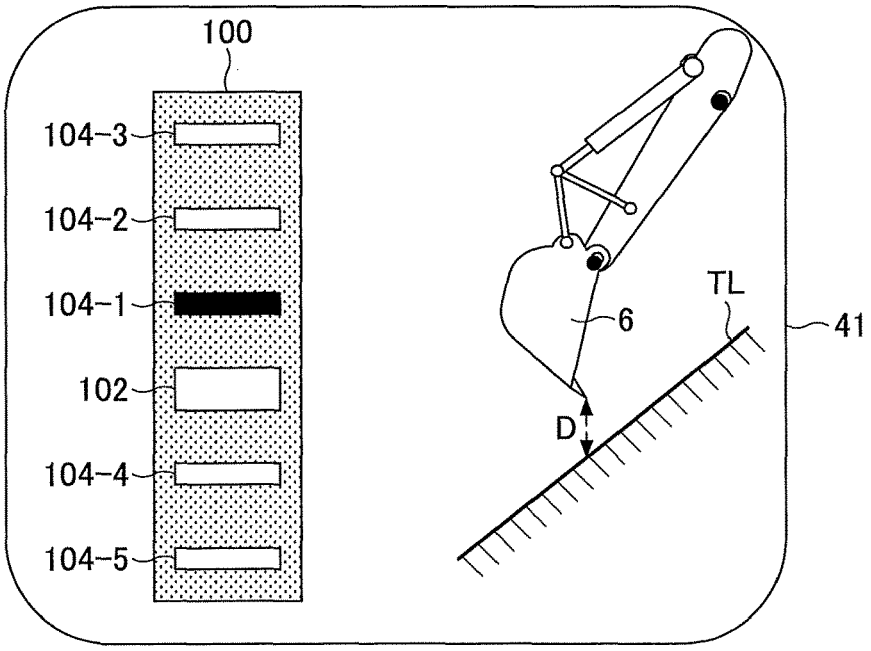
FIG. 7 is a diagram illustrating an example of a display when a bucket is approaching a target surface, in the display example on the image display part illustrated in FIG. 6.

While the distance D between the teeth end of the bucket 6 and the target surface becomes shorter, the display color of the entire display area 100 is changed. For example, if the position of the teeth end of the bucket 6 comes to a position corresponding to the bucket position display bar 104-1 and the distance D becomes short, as illustrated in FIG. 7, only the bucket position display bar 104-1 is painted in black, and the entire display area 100 is displayed in yellow.

Of course, if the position of the teeth end of the bucket 6 comes to a position corresponding to the bucket position display bar 104-2, similarly, only the bucket position display bar 104-2 is painted in black, and the entire display area 100 may be displayed, for example, in orange, which is between red and yellow.

According to the above display control, for example, the operator who saw the entire display area 100 displayed in yellow can instantly recognize that the teeth end of the bucket 6 has come close to the target surface, namely, is positioned above the target surface by a distance of 50 cm or longer and 100 cm or shorter. Note that the color of the entire display area 100 is not specifically limited to red, orange, and yellow as long as colors are distinguishable.

Note that if the current position of the teeth end of the bucket 6 has come to the target surface or in its neighborhood (±5 cm), the target surface display bar 102 is painted in black, and the entire display area 100 is displayed, for example, in blue. The operator who saw the entire display area 100 is displayed in blue can instantly recognize that the teeth end of the bucket 6 has come to the target surface or in its neighborhood (±5 cm).

In the display method illustrated in FIG. 6 and FIG. 7, in addition to changing the display color, the display shade may be periodically changed (flickered or blinked), or the shapes of the bars may be changed (thickened or lengthened). It is possible to further improve the visibility by suitably combining change of the color, flickering or blinking, and change of the shape.

Figure 8:
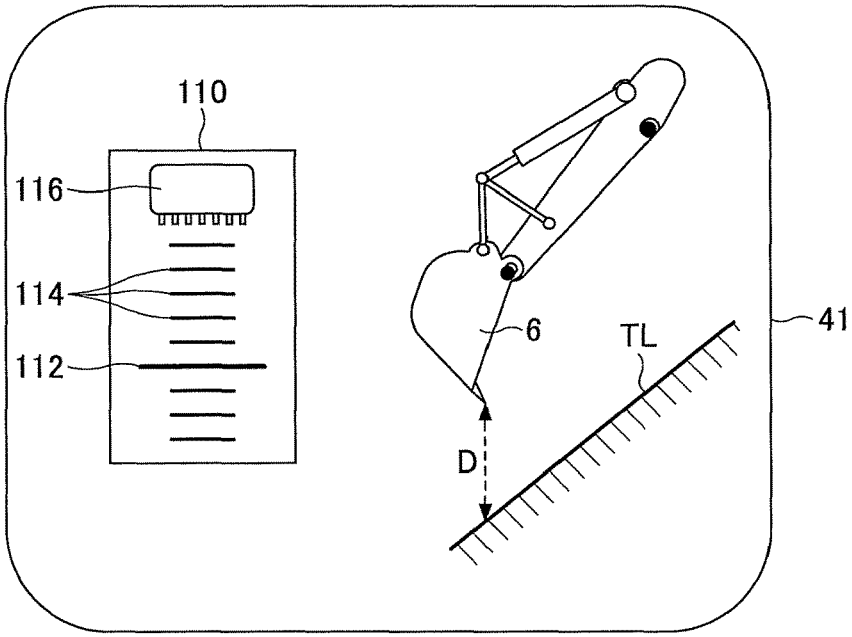
FIG. 8 is a diagram illustrating a display on the image display part in which a modified example of the display area illustrated in FIG. 6 is displayed.

Next, referring to FIG. 8, a modified example of the display method illustrated in FIG. 6 and FIG. 7, will be described. FIG. 8 is a diagram illustrating another example of a display on the image display part 41 when performing excavation work on a slope surface as illustrated in FIG. 5.

A display area 110 different from the display area 100 described above is provided in the left-side area on the display screen 41 illustrated in FIG. 8. Similar to the display area 100, the display area 110 makes it possible to simply and visually recognize the distance D between the teeth-end position of the bucket 6 and the target surface. In the display area 110, a bar (target surface display bar) 112 representing the target surface (target line) is displayed, and above and below the bar 112, multiple bars (distance display bars) 114 representing respective distances from the target surface are displayed at predetermined intervals. In addition, along the sequence of the arranged distance display bars 114, a bucket icon 116 representing the bucket 6 is displayed.

A side having concavities and convexities at the lower end of the bucket icon 116 corresponds to the teeth-end position of the bucket 6. In other words, when the current position of the teeth end of the bucket 6 falls during the work (when the ground is excavated), depending on the distance between the bucket 6 and the target surface, the bucket icon 116 also moves downward from the top in the display area 110.

Figure 9:
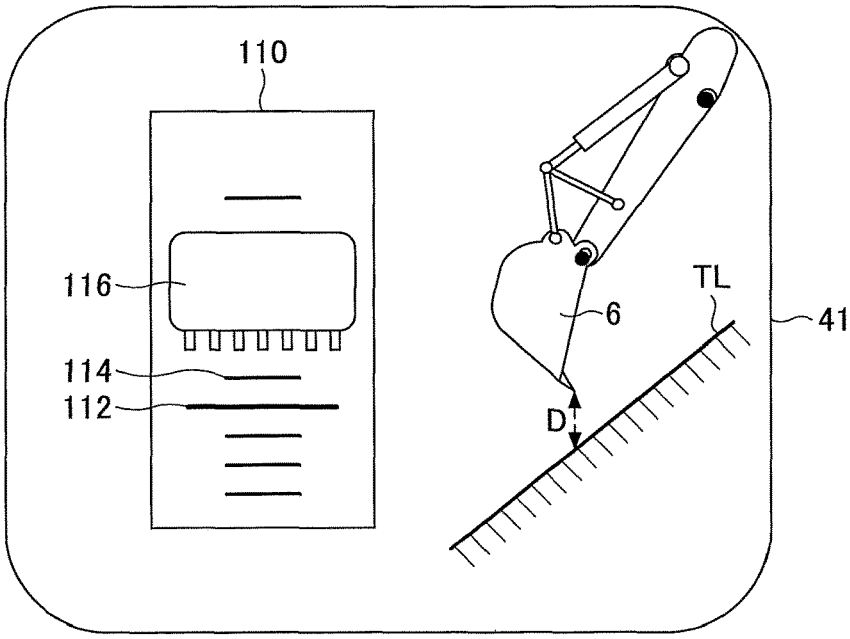
FIG. 9 is a diagram illustrating a display on the image display part in which the shape of the display area is changed from that illustrated in FIG. 8.

Thereupon, the display screen 41 when the bucket 6 descends from the position illustrated in FIG. 8 when the excavation has progressed is illustrated in FIG. 9.

On the display screen illustrated in FIG. 9, the display area 110 becomes larger compared with the display screen in FIG. 8. In other words, this display method changes the size of the display area depending on change of the position of the bucket 6 in the vertical direction. In this case, for example, setting is made so that the longer the distance D between the position of the teeth end of the bucket 6 and the target surface is, and the smaller the display area 110 becomes. In other words the shorter the distance D between the position of the teeth end of the bucket 6 and the target surface is, and the larger the display area 110 becomes. Then, along with the display area 110 becoming larger, the size of the bucket icon 116, the target surface display bar 112, and the distance display bar 114 in the display area 110 also become larger. In this way, since the display area 110 and the bucket icon 116 become larger when the position of the teeth end of the actual bucket 6 approaches the target surface closer, the operator can easily know how much the distance D between the teeth end of the bucket 6 and the target surface is.

In addition, the bucket icon 116 may be flickered or blinked, and the interval of flickering or blinking may be shortened when the bucket 6 approaches the target surface closer.

Note that if the position of the teeth end of the bucket 6 exceeds the target surface, various display methods may be adopted to notify the operator, by making the size of the display area 110 smaller, flickering or blinking the display area 110, and the like.

Also in the display method illustrated in FIG. 8 and FIG. 9, the visibility can be further improved by adding change of the display color, and adding flickering display or blinking display. For example, if the position of the bucket 6 is in a state illustrated in FIG. 8, the entire bucket icon 116 or the entire display area 110 may be displayed in red; if the position of the bucket 6 is in a state illustrated in FIG. 9, the entire bucket icon 116 or the entire display area 110 may be displayed in yellow; or if in a state where the teeth end of the bucket 6 coincides with the target surface, the entire bucket icon 116 or the entire display area 110 may be displayed in blue. As such, the display color may be changed gradually.

Figure 10:
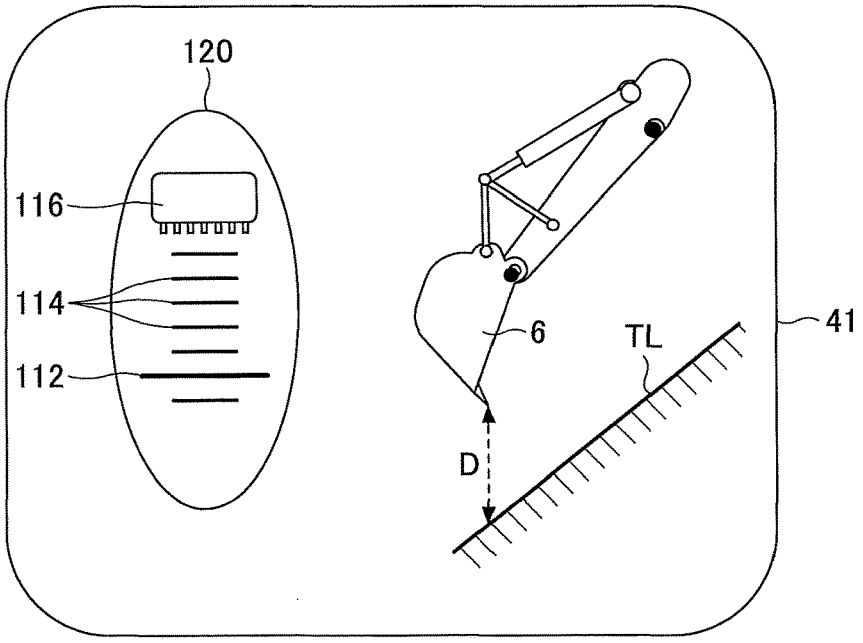
FIG. 10 is a diagram illustrating a display on the image display part in which the shape (size) of the display area is changed from that illustrated in FIG. 8.
Figure 11:
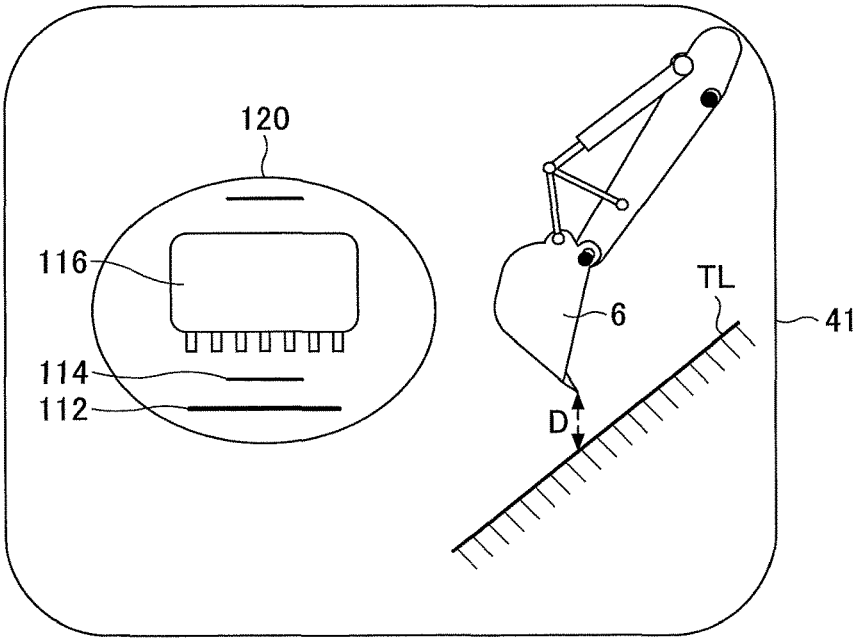
FIG. 11 is a diagram illustrating a display on the image display part in which the shape of the display area is changed from that illustrated in FIG. 10.

Furthermore, as illustrated in FIG. 10 and FIG. 11, the shape of the display area may be changed gradually. A display area 120 illustrated in FIG. 10 has a longitudinally long elliptic shape. When the bucket 6 approaches the target surface closer, as illustrated in FIG. 11, the display area 120 gradually changes into a laterally long elliptic shape. When the teeth end of the bucket 6 reaches the target surface, the aspect ratio of the ellipse of the display area 120 is reversed with respect to the longitudinally long elliptic shape illustrated in FIG. 10, and the shape of the display area 120 becomes a completely laterally long ellipse.

Figure 12:
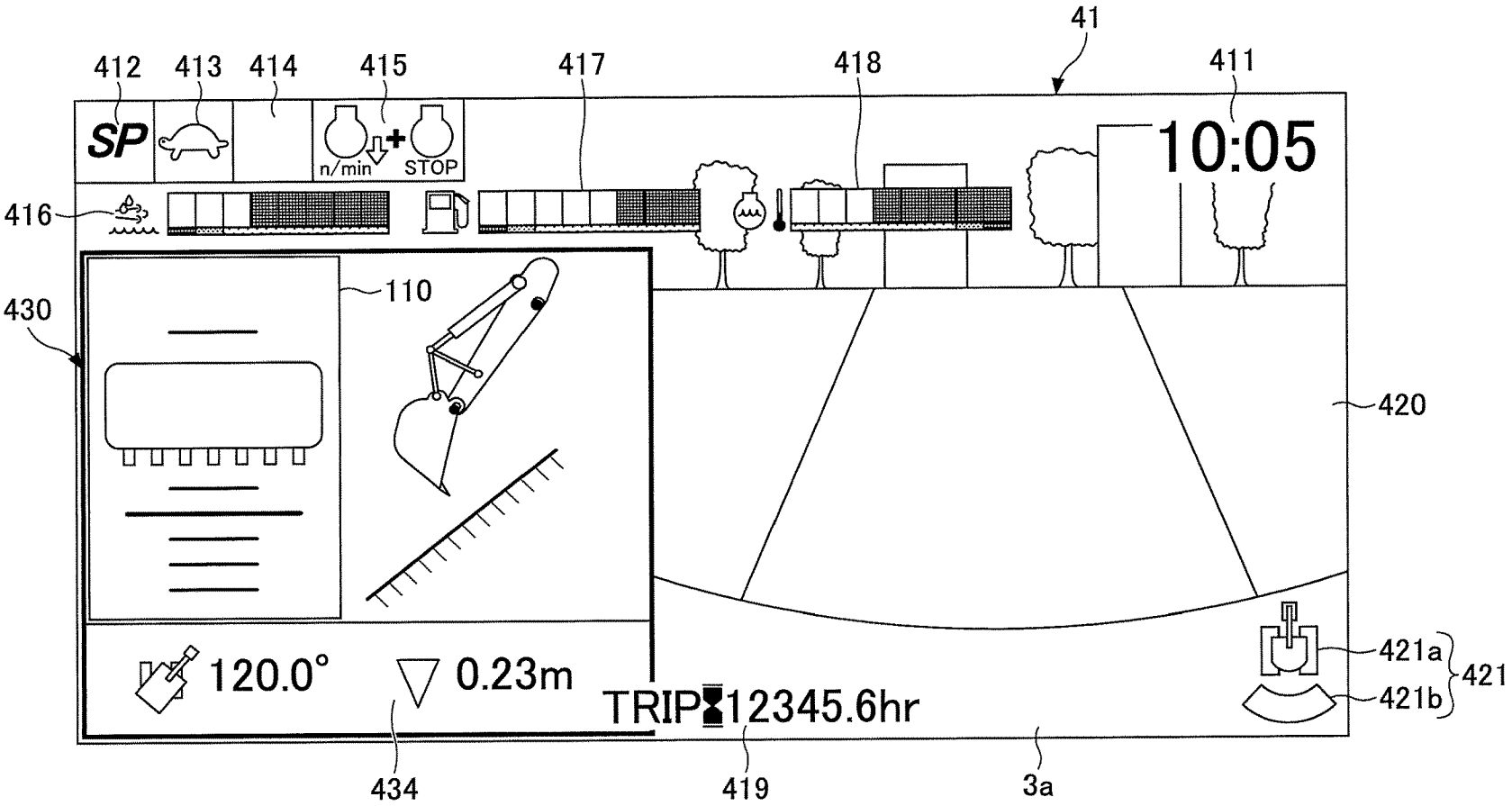
FIG. 12 is a diagram illustrating another example of an image displayed on the image display part.

Furthermore, for example, an image illustrating the distance between the position of the teeth end of the bucket 6 and the target surface may be displayed along with various information items related to the shovel. FIG. 12 is a diagram illustrating another example of the image displayed on the image display part 41.

The display screen illustrated in FIG. 12 includes a time display part 411, a revolution mode display part 412, a traveling mode display part 413, an attachment display part 414, an engine control state display part 415, a residual urea water quantity display part 416, a residual fuel quantity display part 417, a cooling water temperature display part 418, a cumulative engine operation time display part 419, a captured image display part 420, and a work guidance display part 430.

The time display part 411 displays the present time. In the example illustrated in FIG. 12, a present time (10:05) is illustrated.

The revolution mode display part 412 displays a revolution mode. In the example illustrated in FIG. 12, a symbol "SP" representing the SP mode is displayed.

The traveling mode display part 413 displays a traveling mode. For example, traveling modes may include a slow mode and a fast mode; a symbol of "tortoise" is displayed in the slow mode, and a symbol of "rabbit" is displayed in the fast mode. In the example illustrated in FIG. 12, the symbol of "tortoise" is displayed.

The attachment display part 414 displays, for example, an image representing an equipped attachment.

The engine control state display part 415 displays a control state of the engine 11. In the example illustrated in FIG. 12, "automatic slowdown and automatic stop mode" is selected as a control state of the engine 11. Note that the "automatic slowdown and automatic stop mode" means a control state in which the number of revolutions of the engine is automatically reduced depending on duration of a state during which the load of the engine is small, and if the state of the load of the engine being small further continues, the engine 11 is automatically stopped. Other control states of the engine 11 may include "automatic slowdown mode", "automatic stop mode", and "manual slowdown mode".

A bar graph representing a state of the residual quantity of urea water stored in a urea water tank is displayed on the residual urea water quantity display part 416.

A bar graph representing a state of the residual quantity of fuel stored in a fuel tank is displayed on the residual fuel quantity display part 417.

A bar graph representing a state of the temperature of the engine cooling water is displayed on the cooling water temperature display part 418.

The cumulative engine operation time display part 419 displays a cumulative operation time of the engine 11. On the cumulative engine operation time display part 419, the cumulative operation time since the shovel was manufactured, or a cumulative operation time after the timer is restarted by the operator is displayed.

An image captured by the imaging unit is displayed on the captured image display part 420; for example, an image is displayed that has been captured by a back monitoring camera, a left-side monitoring camera, a right-side monitoring camera, or the like.

The imaging unit icon 421 representing an orientation of the imaging unit that has captured the image on display is displayed on the captured image display part 420. The imaging unit icon 421 consists of a shovel icon **421*a* representing a top view of the shape of the shovel, and an orientation display icon 421*b*** representing the orientation of the imaging unit that has captured the image on display.

In the example illustrated in FIG. 12, the orientation display icon **421*b* is displayed on the lower side of the shovel icon 421*a* (the side opposite to the attachment), which indicates that an image behind the shovel captured by the back monitoring camera is displayed on the captured image display part 420**.

The operator can switch an image to be displayed on the captured image display part 420 to an image captured by another camera, for example, by pressing down an image switching button provided in the cabin 10.

Note that if an imaging unit is not provided in the shovel, different information may be displayed instead of the captured image display part 420.

On the work guidance display part 430, an image representing the distance between the position of the teeth end of the bucket 6 and target surface, for example, an image as described above with reference to FIG. 9, is displayed. Here, the size of the display area 110 is displayed larger in the work guidance display part 430. In this way, when the teeth end of the bucket 6 approaches the target surface closer, the display area 110 is expanded to be displayed. By changing the way of displaying the display area 110 (for example, magnification or reduction, and change of the color) depending on the distance between the position of the teeth end of the bucket 6 and the target surface, the operator can securely recognize information to be notified on the image display part 41. Furthermore, as an image presenting numerical information 434, a revolution angle (120.0 degrees) of the revolving upper body 3 with respect to a reference is displayed along with an icon illustrating the shovel. Moreover, as the image presenting numerical information 434, a distance (0.23 m) from the target surface to the teeth end of the bucket 6 is displayed along with a predetermined icon.

Alternatively, for example, when the shovel is operated, an image as illustrated in FIG. 9 may be displayed on the image display part 41, and when the shovel is not operated, an image as illustrated in FIG. 12 may be displayed on the image display part 41. Note that whether the shovel is operated or not can be determined, for example, by the controller based on detection results obtained by the oil pressure sensors **15*a* and 15*b***.

Note that in the embodiment described above, although the visibility is improved by changing the display color, the size, the shape, the display shade (including flickering or blinking) on the display area being a partial area of the display screen 41, the visibility may be improved by changing the display color or the display shade (including flickering or blinking) on the entire area of the display screen 41.

For example, in the display illustrated in FIG. 6, suppose that the display color is not changed in the display area 100, and the display area 100 is displayed, for example, in black and white. Instead, depending on the distance D from the teeth end of the bucket 6 to the target surface, the background color of the entire display screen 41 may be changed gradually. For example, if the position of the teeth end of the bucket 6 corresponds to the bucket position display bar 104-3, which indicates that the teeth end of the bucket 6 is the furthest from the target surface, the background color of the entire display screen 41 may be displayed in red. Then, while the position of the teeth end of the bucket 6 is approaching the target surface, shifting to the bucket position display bar 104-2 and the bucket position display bar 104-1, the background color may be changed from red to yellow. If the position of the teeth end of the bucket 6 reaches the target surface display bar 102, the background color of the entire display screen 41 may be displayed in blue. This makes it possible for the operator to confirm the position of the bucket 6 by the changing color of the entire display screen 41, which is sensed in the corner of the operator's field of view, without directly watching the display contents on the display screen 41 carefully. Instead of changing the color, it is possible to further improve the visibility, by periodically changing the shade of the entire display screen 41 (flickering or blinking), or changing the time interval of flickering or blinking.

As above, the examples have been described in which the working part of the attachment is the tip (teeth end) of the bucket 6; however, any position of the bucket 6 may be used as the working part. For example, it is often the case that the work on the slope surface is performed by using the back surface of the bucket 6. In this case, it is desirable to use the back surface of the bucket 6 as the working part.

It should be understood that the invention is not limited to the above-described embodiment, but may be modified into various forms on the basis of the spirit of the invention. Additionally, the modifications are included in the scope of the invention.

What is claimed is:

1. A shovel comprising:

an attachment configured to execute work;

a guidance unit configured to guide an operation of the attachment; and a display unit configured to display information related to the work by the attachment, a sensor providing detection signals from which a distance between a position of the attachment and a target surface can be determined, wherein the guidance unit changes color of a partial area or an entire area of a surrounding of an image indicating the determined distance between a position of the attachment and a target surface displayed on a display screen of the display unit, depending on the distance between the position of the attachment while the work is being performed and the target surface as a reference of the work.

2. The shovel as claimed in claim 1, wherein the guidance unit displays an image of the attachment and a target line representing the target surface, on the display screen.

3. The shovel as claimed in claim 1, wherein the guidance unit changes a shape or a size of the partial area of the display screen, depending on the distance between the position of the attachment while the work is being performed and the target surface.

4. The shovel as claimed in claim 1, wherein the guidance unit blinks the partial area or the entire area of the display screen, and changes a time interval of the blinking, depending on the distance between the position of the attachment while the work is being performed and the target surface.

5. The shovel as claimed in claim 1, wherein the area whose color is changed depending on the distance between the position of the attachment while the work is being performed and the target surface, includes position display bars arranged and displayed in a vertical direction on the display screen, which are end attachment position display bars to represent the position of the attachment with respect to the target surface.

6. The shovel as claimed in claim 3, wherein the area whose size is changed depending on the distance between the position of the attachment while the work is being performed and the target surface, includes position display bars arranged and displayed in a vertical direction on the display screen, which are end attachment position display bars to represent the position of the attachment with respect to the target surface.

7. The shovel as claimed in claim 1, wherein the attachment includes a bucket, and wherein the guidance unit displays an image of a side view of a part of the shovel including the bucket, depending on the distance between the position of the bucket and the target surface.

8. The shovel as claimed in claim 1, wherein the attachment includes a bucket, and wherein the guidance unit displays an image of a front view of the shovel, and an image of a side view of a part of the shovel including the bucket, depending on the distance between the position of the bucket and the target surface.

9. The shovel as claimed in claim 1, wherein the guidance unit further displays the distance between the position of the bucket and the target surface, along with a triangular icon.

10. The shovel as claimed in claim 1, wherein the guidance unit further displays a revolution angle of a revolving upper body of the shovel with respect to a reference, along with an icon of the shovel.

* * * * *